US006257763B1

(12) United States Patent
Stolmeier et al.

(10) Patent No.: US 6,257,763 B1
(45) **Date of Patent: *Jul. 10, 2001**

(54) TAMPER EVIDENT ZIPPER SLIDER

(75) Inventors: Robert C. Stolmeier, Shelbyville; Ronald G. Thieman, Noblesville, both of IN (US); James W. Burke, Cleves, OH (US); Thomas P. O'Connor, Shelbyville, IN (US)

(73) Assignee: Huntsman KCL Corporation, Shelbyville, IN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/090,851

(22) Filed: Jun. 4, 1998

Related U.S. Application Data

(63) Continuation-in-part of application No. 08/832,206, filed on Apr. 8, 1997, now abandoned.

(51) Int. Cl.[7] ..... B65D 33/16
(52) U.S. Cl. ..... 383/5; 383/61; 383/63; 383/64
(58) Field of Search ..... 383/5, 61, 63, 383/64, 65

(56) References Cited

U.S. PATENT DOCUMENTS

| | | | | |
|---|---|---|---|---|
| Re. 33,674 | | 8/1991 | Uramoto . | |
| Re. 34,554 | | 3/1994 | Ausnit . | |
| 2,978,769 | | 4/1961 | Harrah . | |
| 2,994,469 | | 8/1961 | Troup et al. . | |
| 3,054,434 | | 9/1962 | Ausnit et al. . | |
| 3,122,807 | | 3/1964 | Ausnit . | |
| 3,172,443 | | 3/1965 | Ausnit . | |
| 3,181,583 | * | 5/1965 | Lingenfelter | 383/61 |
| 3,226,787 | | 1/1966 | Ausnit . | |
| 3,462,068 | * | 8/1969 | Suominen | 383/15 |
| 3,780,781 | | 12/1973 | Uramoto . | |
| 3,991,801 | | 11/1976 | Ausnit . | |
| 4,196,030 | | 4/1980 | Ausnit . | |
| 4,285,376 | | 8/1981 | Ausnit . | |
| 4,337,889 | | 7/1982 | Moertel . | |
| 4,637,063 | | 1/1987 | Sullivan et al. . | |
| 4,713,839 | | 12/1987 | Peppiatt . | |
| 4,874,257 | | 10/1989 | Inagaki | 383/63 |
| 4,923,309 | | 5/1990 | VanErden . | |
| 4,925,316 | * | 5/1990 | Van Erden et al. | 383/61 |
| 4,927,271 | | 5/1990 | Branson . | |
| 4,966,470 | | 10/1990 | Thompson et al. . | |
| 4,971,454 | | 11/1990 | Branson et al. . | |
| 4,976,811 | | 12/1990 | Siebert . | |
| 5,007,142 | | 4/1991 | Herrington . | |
| 5,007,143 | | 4/1991 | Herrington . | |
| 5,010,627 | | 4/1991 | Herrington et al. . | |
| 5,020,194 | | 6/1991 | Herrington et al. . | |
| 5,023,122 | | 6/1991 | Boeckmann et al. . | |
| 5,063,644 | | 11/1991 | Herrington et al. . | |
| 5,067,208 | | 11/1991 | Herrington, Jr. et al. . | |
| 5,085,031 | | 2/1992 | McDonald | 53/412 |
| 5,092,684 | | 3/1992 | Weeks . | |
| 5,121,997 | | 6/1992 | LaPierre et al. . | |
| 5,131,121 | | 7/1992 | Herrington, Jr. et al. . | |
| 5,161,286 | | 11/1992 | Herrington, Jr. et al. . | |
| 5,186,543 | | 2/1993 | Cochran . | |
| 5,205,649 | * | 4/1993 | Fullerton | 383/78 |
| 5,211,482 | | 5/1993 | Tilman . | |

(List continued on next page.)

*Primary Examiner*—Stephen P. Garbe
(74) *Attorney, Agent, or Firm*—Woodard, Emhardt, Naughton, Moriarty & McNett

(57) ABSTRACT

A plastic film bag includes a reclosable closure which is opened and closed by a slider. The bag includes a tamper evident sheet closing off the bag mouth. Alternatively the tamper evident means consists of a hood which encloses the slider and reclosable closure.

35 Claims, 18 Drawing Sheets

U.S. PATENT DOCUMENTS

| | | | | |
|---|---|---|---|---|
| 5,224,779 | | 7/1993 | Thompson et al. . | |
| 5,283,932 | | 2/1994 | Richardson et al. . | |
| 5,293,671 | | 3/1994 | Oda . | |
| 5,301,394 | | 4/1994 | Richardson et al. . | |
| 5,366,294 | | 11/1994 | Wirth et al. . | |
| 5,425,825 | | 6/1995 | Rasko et al. . | |
| 5,435,864 | | 7/1995 | Machacek et al. . | |
| 5,442,837 | | 8/1995 | Morgan . | |
| 5,442,838 | | 8/1995 | Richardson et al. . | |
| 5,448,807 | | 9/1995 | Herrington, Jr. . | |
| 5,456,928 | | 10/1995 | Hustad et al. . | |
| 5,480,230 | | 1/1996 | May . | |
| 5,482,375 | | 1/1996 | Richardson et al. . | |
| 5,492,411 | | 2/1996 | May . | |
| 5,669,715 | | 9/1997 | Dobreski et al. . | |
| 5,711,609 | * | 1/1998 | Simonsen | 383/5 |
| 5,713,669 | | 2/1998 | Thomas et al. . | |
| 5,911,508 | * | 6/1999 | Dobreski et al. | 383/5 |
| 5,964,532 | * | 6/1999 | Phillips et al. | 383/5 |

* cited by examiner

TAMPER EVIDENT ZIPPER SLIDER

This application is a continuation-in-part of U.S. patent application Ser. No. 08/832,206, filed Apr. 8, 1997 now abandoned.

FIELD OF THE INVENTION

The present invention relates to reclosable plastic bags with slider zippers and tamper evidence.

DESCRIPTION OF THE PRIOR ART

Various inventions have been made in the area of reclosable plastic bags with slider zippers. For example the Herrington U.S. Pat. No. 5,007,143 shows a zipper profile which is opened and closed by a slider that is grasped by the user for opening and closing the bag. It is desirable in certain situations to provide tamper evidence to the user of a reclosable bag. The Hustad et al. U.S. Pat. No. 5,456,928 is an example of a patent disclosing a reclosable bag for use with food products which has tamper evident means incorporated therein. There are certain situations, for example, where a slider zipper reclosable bag is used to contain a product that is being marketed and it is also desirable to provide tamper evidence.

SUMMARY OF THE INVENTION

One embodiment of the invention might include a plastic film bag having a pair of side walls which are secured to one another and define a mouth of the bag. There is provided a reclosable fastener extending along the mouth of the bag and secured to the side walls. The fastener includes a pair of flexible fastening strips secured to the side walls and including reclosable interlocking rib and groove profile elements on the respective strips. A slider straddles the fastener for opening and closing the fastener. The slider includes a depending separator extending between the flexible plastic strips. There is also provided a sheet of plastic film closing the mouth of the bag which sheet is capable of rupture to provide access and tamper evidence.

In an alternative embodiment, each of the pair of side walls of the plastic film bag has an upper region that forms a sheet of plastic film disposed between the side walls for closing the mouth of the bag.

In yet another embodiment, one of the pair of side walls of the plastic film bag is secured to the inner face of one of the pair of flexible plastic strips and the other of the pair of side walls is secured to the inner face of the other of the pair of flexible plastic strips. The sheet preferably forms at least one curved region. The sheet allows the flexible plastic strips to separate from each other a greater distance when the rib and groove profile elements are in a non-interlocked configuration. In another embodiment, one of the pair of side walls is secured to an outer face of one of the pair of flexible plastic strips and the other of the pair of side walls is secured to an outer face of the other of the pair of flexible plastic strips.

DESCRIPTION OF THE PREFERRED EMBODIMENT

Figure 1:
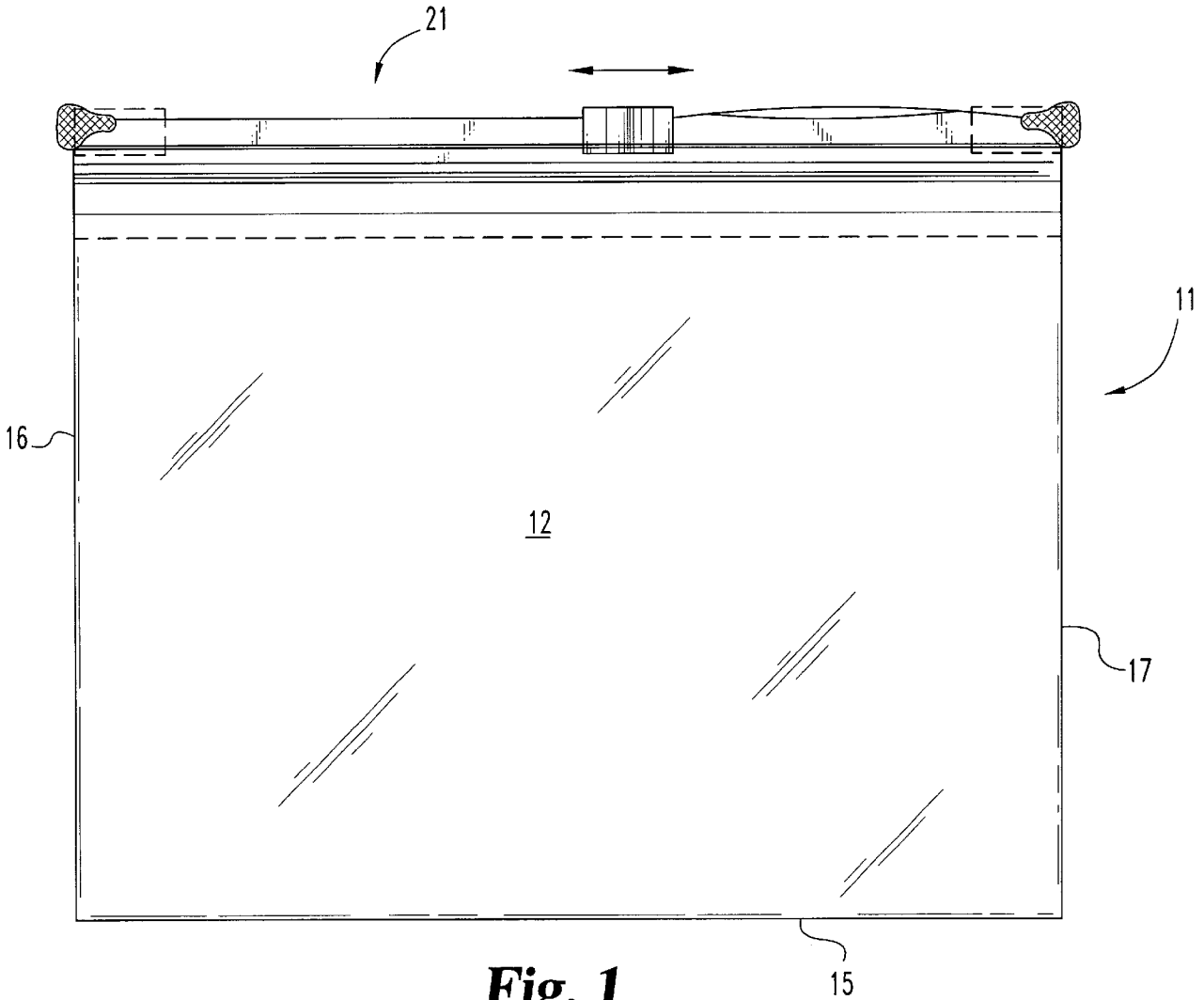
FIG. 1 is front elevational view of a reclosable plastic bag including the tamper evident zipper slider of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, a plastic bag 11 is illustrated which consists of a pair of side walls 12 and 13 which are connected together at the bottom and at the sideward edges 16 and 17 of the bag. The connection at the bottom 15 may be merely by folding a single sheet of plastic to produce the two side walls 12 and 13 or may be by actual melting and cutting or adhering the two side walls together by adhesive. The side edges 16 and 17 are frequently formed by melting the two side walls together and then by cutting apart from the adjacent side walls of further bags being produced. The two side walls 12 and 13 define a mouth 20 of the bag along which a reclosable fastener 21 extends. The fastener includes a pair of flexible plastic strips 22 and 25 which are secured to the side walls 12 and 13 and include reclosable interlocking rib and groove profile elements 26, 27, 30 and 31. The reclosable fastener further includes a flange 32 which functions to close over the top of the fastener when it is in closed position.

Figure 2:
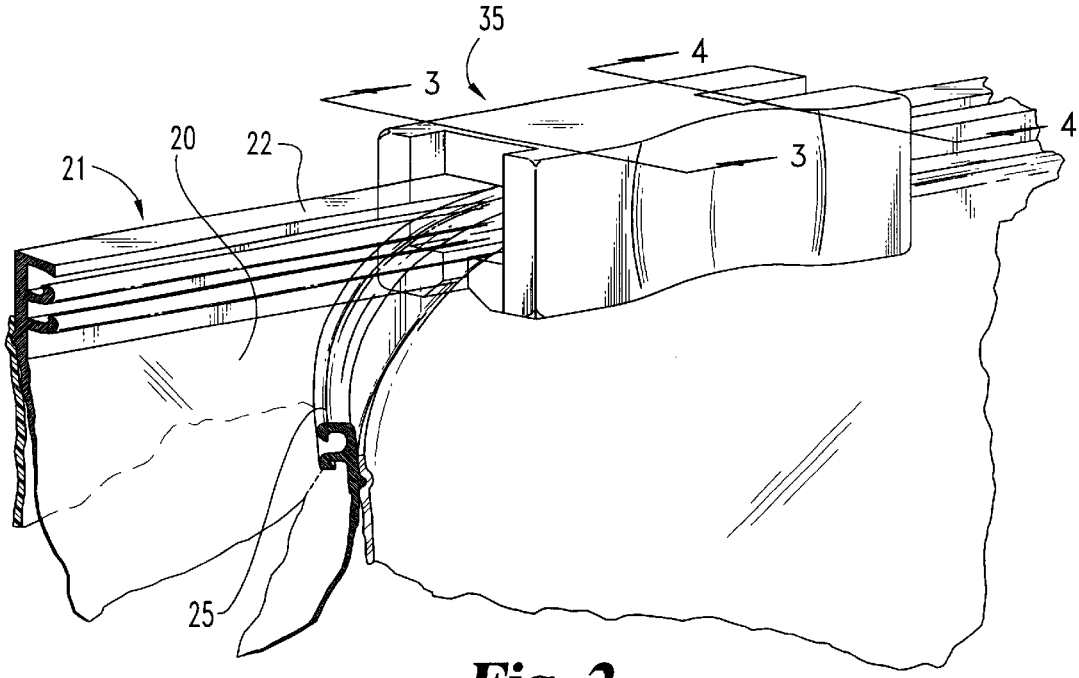
FIG. 2 is a fragmentary perspective view of a portion of the structure of FIG. 1.
Figure 2A:
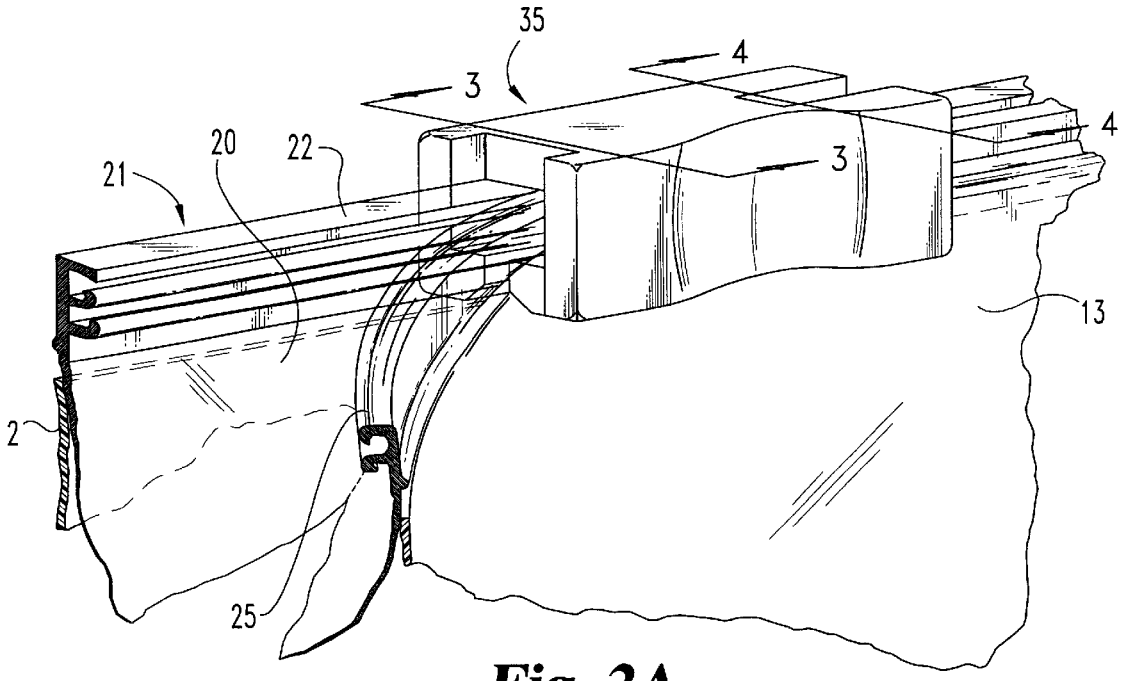
FIG. 2A is a view similar to FIG. 2 of an alternative embodiment of the present invention.
Figure 3:
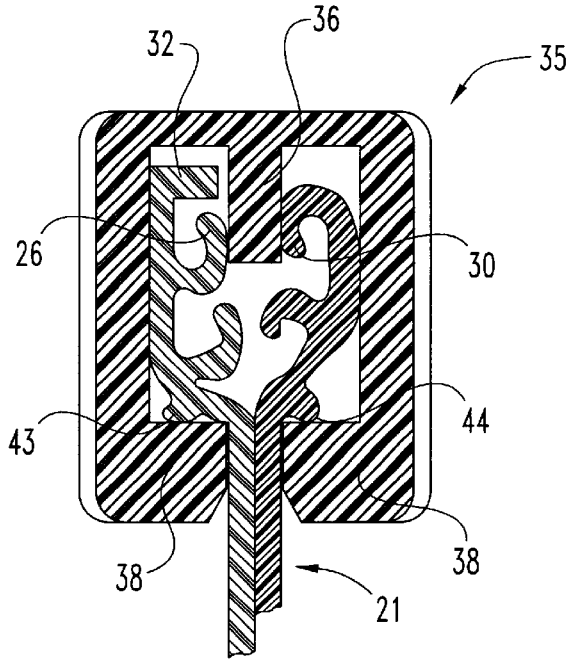
FIG. 3 is a vertical section taken along the line 3—3 of FIG. 2 in the direction of the arrows.
Figure 4:
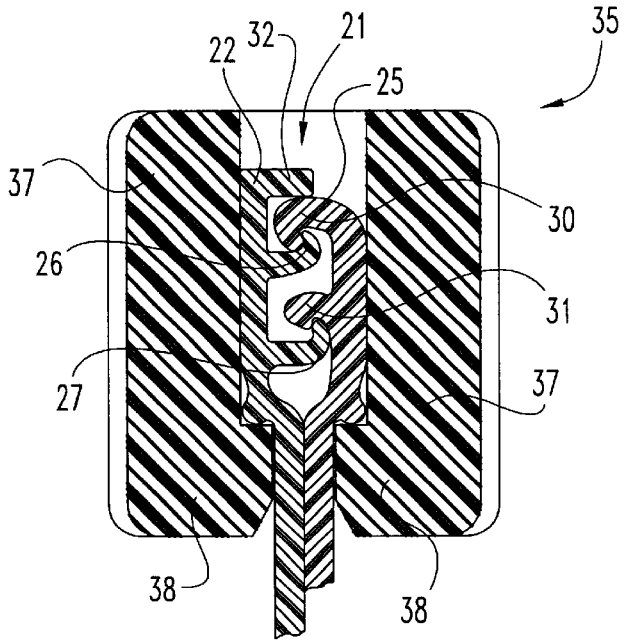
FIG. 4 is a vertical section taken along the line 4—4 of FIG. 2 in the direction of the arrows.
Figure 5:
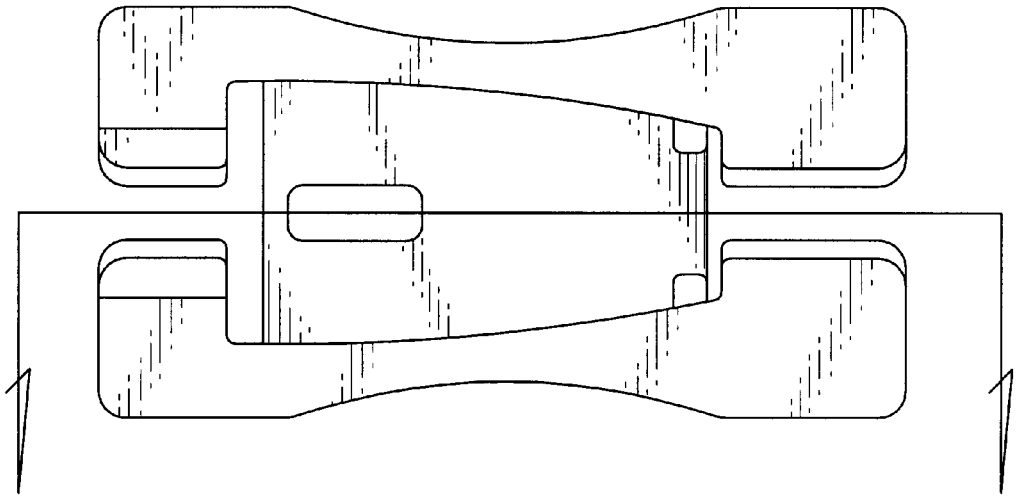
FIG. 5 is a bottom plan view of the slider of the present invention.
Figure 6:
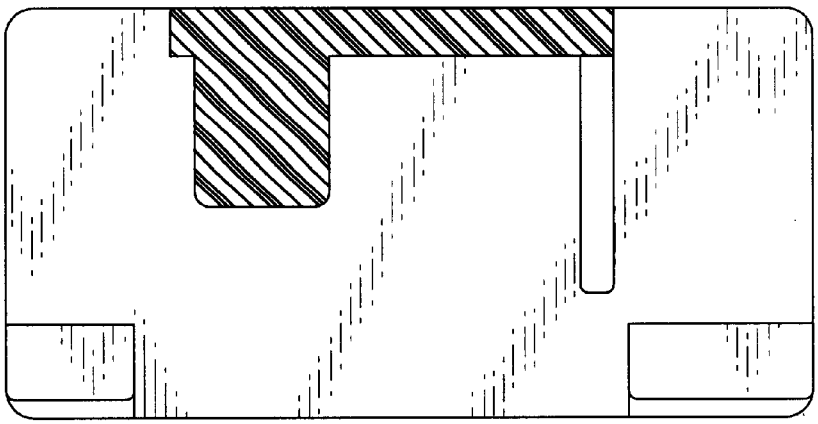
FIG. 6 is a section taken along the line 6—6 of FIG. 5 in the direction of the arrows.

A slider 35 is arranged to straddle the fastener 21 for opening and closing the fastener. The slider 35 has a fixed separator member 36 which extends down between the profile elements 26 and 30 for the purpose of separating them and opening the fastener when the slider is moved rightwardly as viewed in FIG. 2. FIG. 3 shows the slider section taken along the line 3—3 of FIG. 2 and shows the profile elements in open condition. When the slider is moved leftwardly as viewed in FIG. 2 the slider functions to close the profile elements and to connect them as shown in FIG. 4. The connection occurs by reason of the walls 37 of the slider squeezing the profile elements together. The embodiment depicted in FIG. 2A is identical to that shown in FIG. 2 with the exception that side walls 12 and 13 are attached to flexible plastic strips 22 and 25, respectively, such that interference of the side walls with slider 35 is minimized.

The slider is retained on the fastener elements by shoulders 43 and 44 which are also formed on the fastener elements. The slider has inwardly projecting flanges 38 which engage the shoulders 43 and 44 to retain the slider on the fastener.

Figure 8:
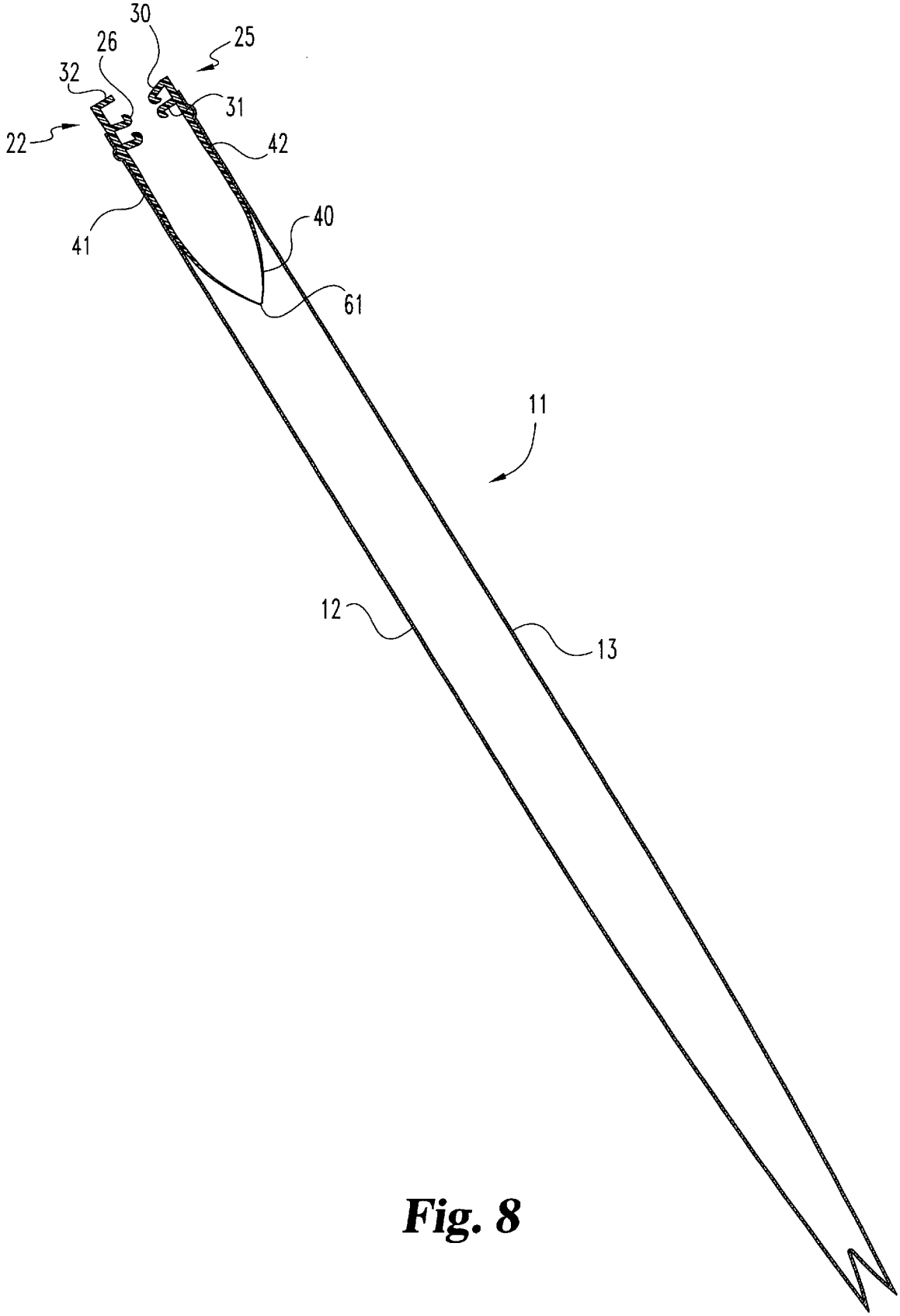
FIG. 8 is a vertical section taken through the zipper slider and the bag of FIG. 1.
Figure 8A:
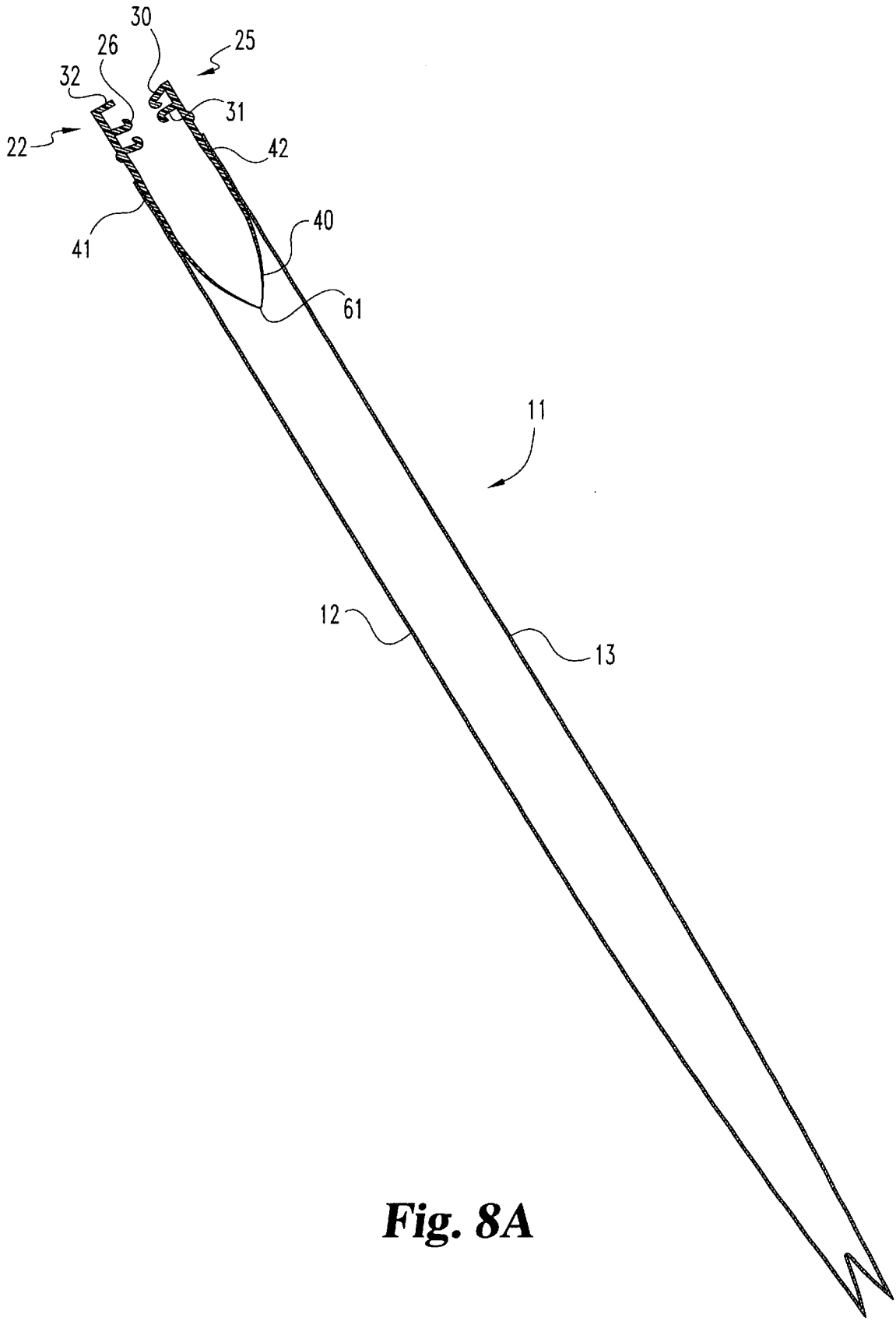
FIG. 8A is a view similar to FIG. 8 of an alternative embodiment of the present invention.
Figure 9:
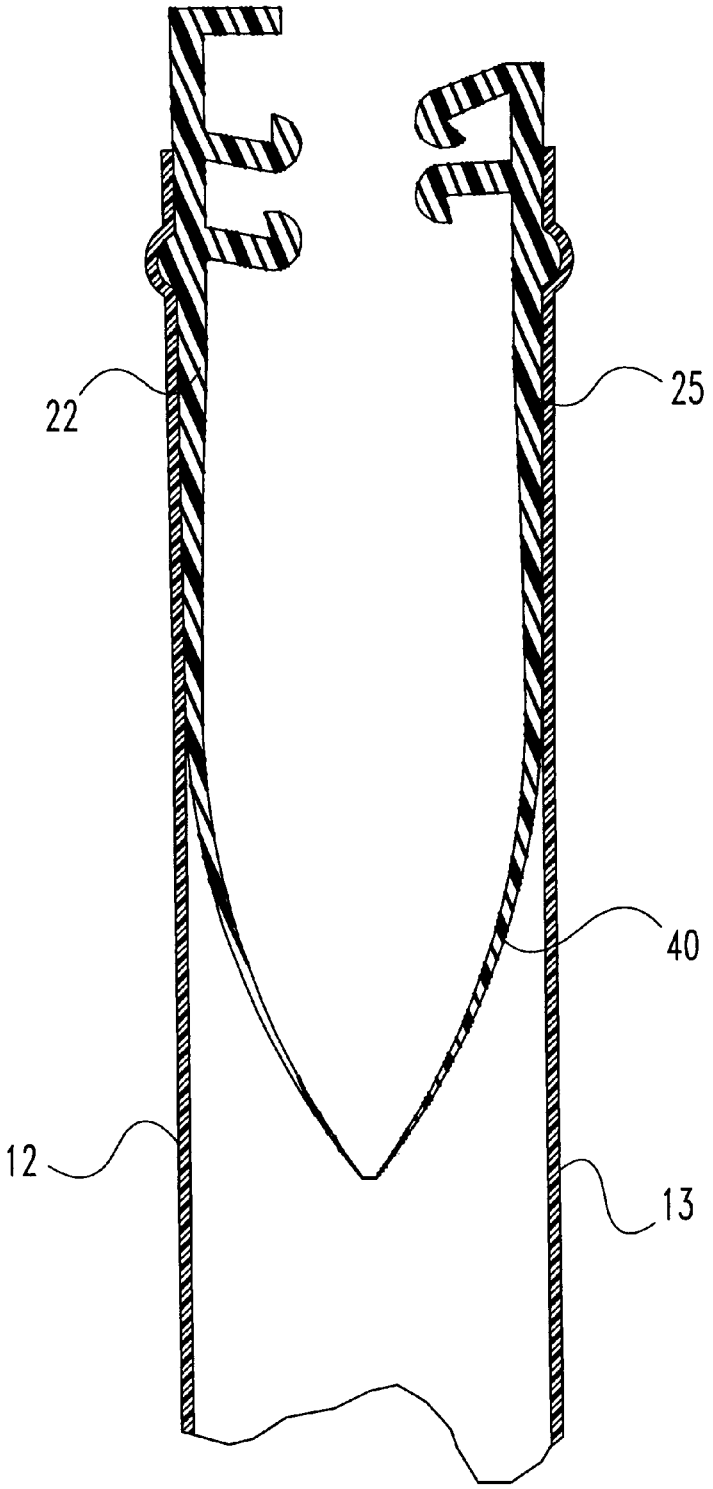
FIG. 9 is an enlarged fragmentary view similar to FIG. 8.
Figure 9A:
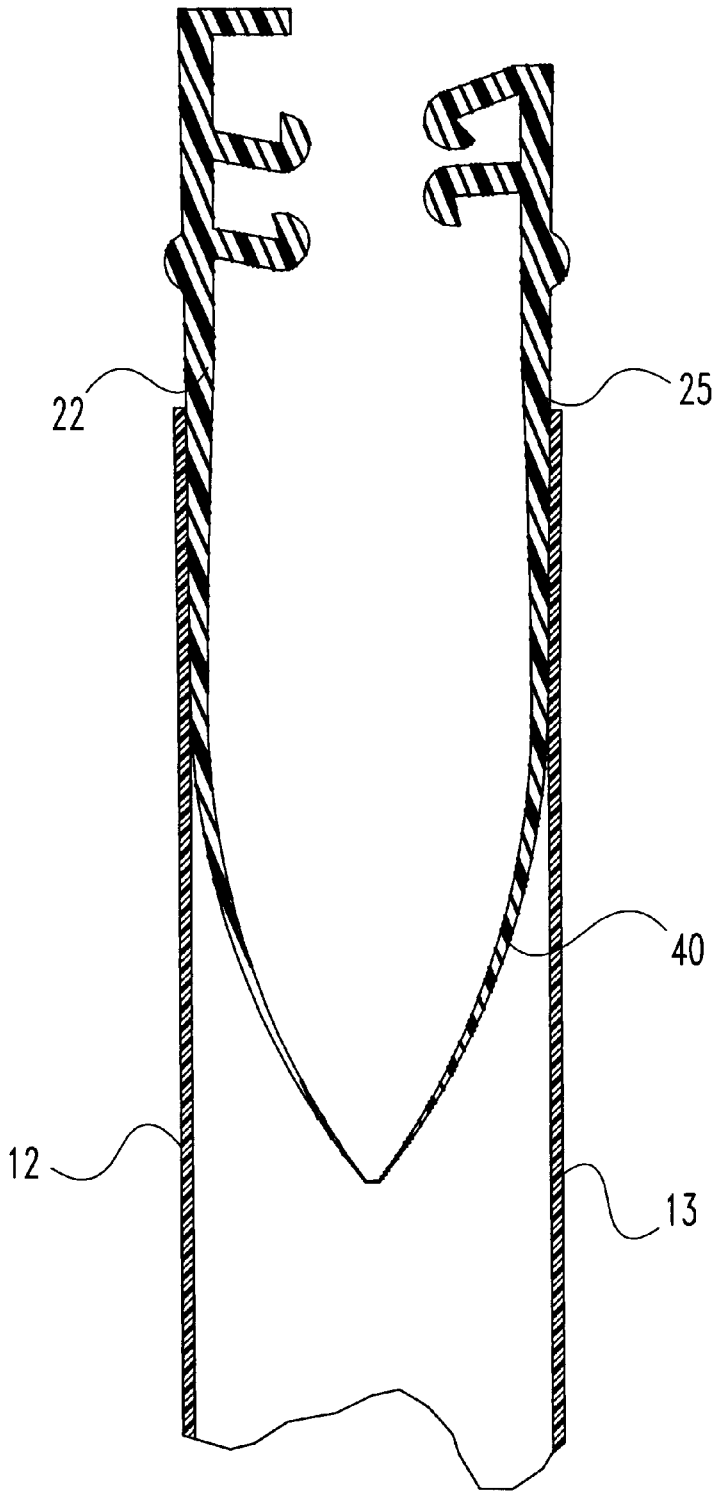
FIG. 9A is an enlarged fragmentary view similar to FIG. 8A.

Referring to FIG. 8 the reclosable fastener has formed homogenously and coextensively therewith a sheet of plastic 40. This sheet of plastic 40 may be extruded along with the fastener elements 22 and 25 but has a somewhat less thick construction than the strips 22 and 25 and particularly the web portion thereof 41 and 42. The embodiment shown in FIG. 8A is identical to that shown in FIG. 8 with the exception that side walls 12 and 13 are attached to flexible plastic strips 22 and 25, respectively, such that interference of the side walls with the slider (not shown) is minimized.

It is intended that the present bag be used frequently in situations where the bag is filled at the factory with a product and then is marketed to the consumer. The consumer then buys the bag and is reassured that it has not been tampered with because the closure 40 is in place and needs to be ruptured before the consumer can use the contents of the bag. If the consumer does not wholly consume the contents he can then reclose the bag and use it further to contain the partially filled bag.

Figure 10:
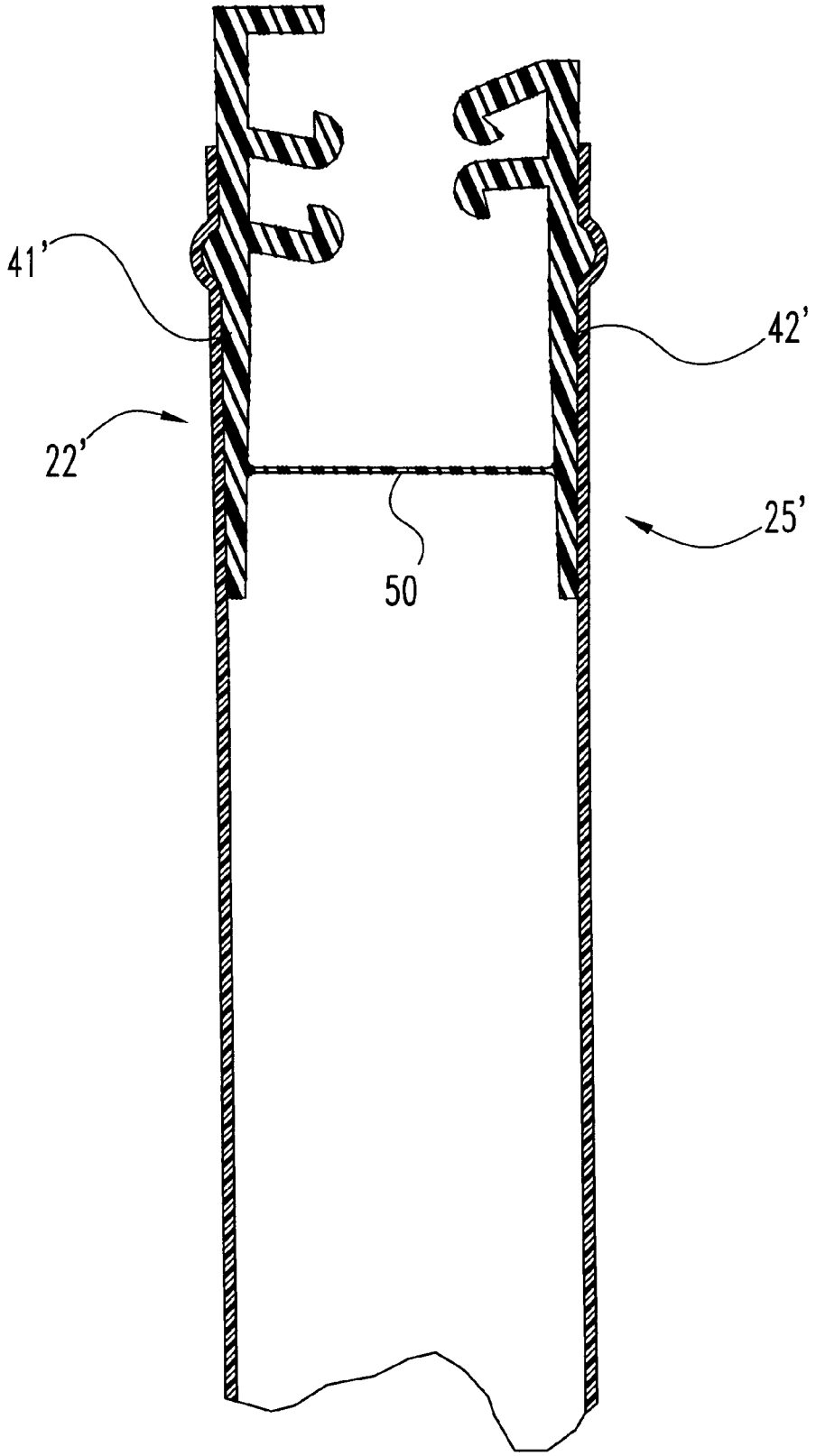
FIG. 10 is a view similar to FIG. 8 of an alternative embodiment of the present invention.
Figure 10A:
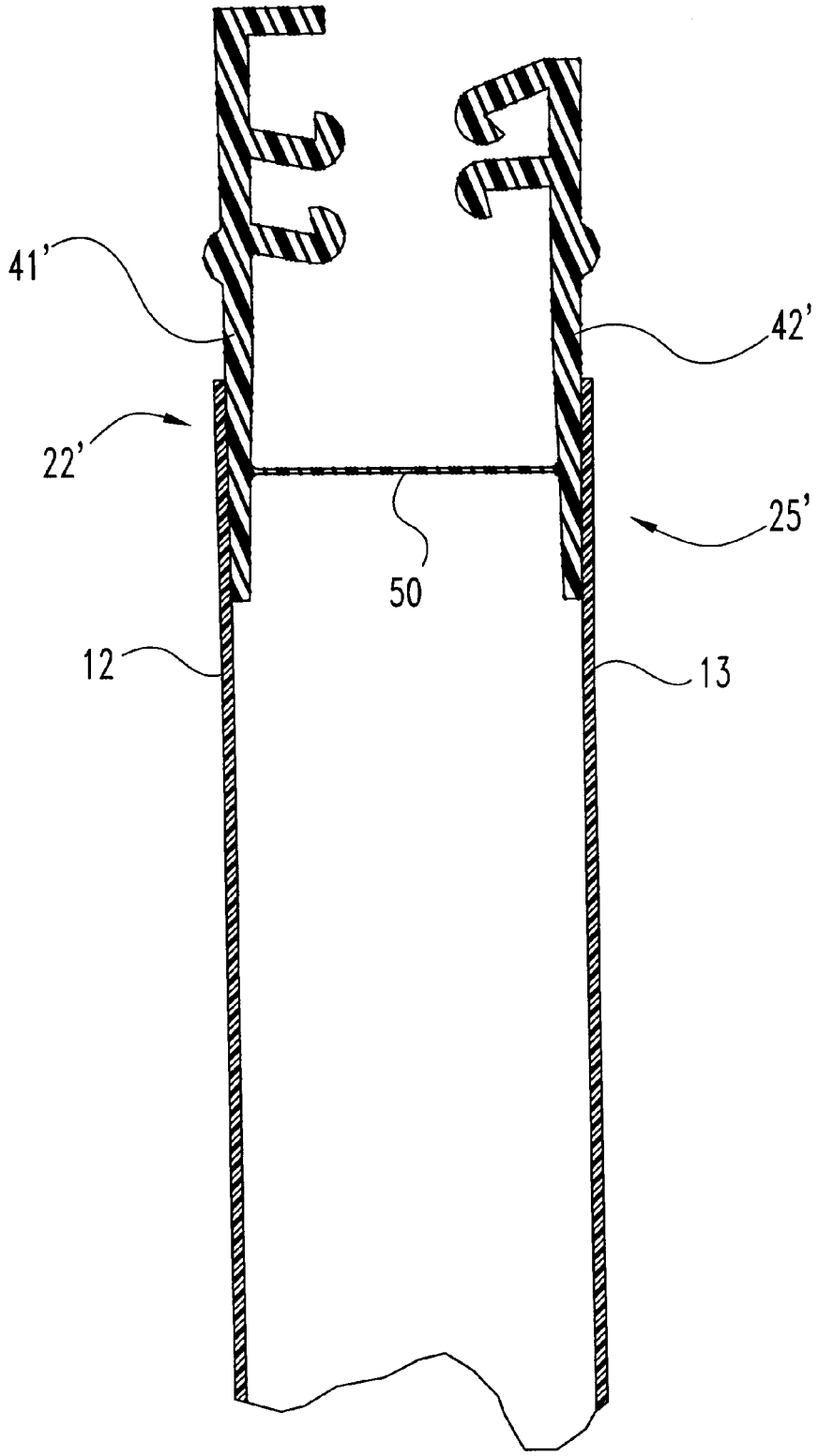
FIG. 10A is a view similar to FIG. 10 of a further alternative embodiment of the present invention.

An alternative embodiment of the reclosable fastener of FIG. 8 is shown in FIG. 10 and involves a tamper evidence closure 50 that extends between the walls or webs 41' and 42' of the reclosable fastener elements 22' and 25'. The construction of FIG. 10 is extruded in a similar fashion to the construction of FIG. 8. The embodiment shown in FIG. 10A is identical to that shown in FIG. 10 with the exception that side walls 12 and 13 are attached to flexible plastic strips 22' and 25', respectively, such that interference of the side walls with the slider (not shown) is minimized.

Figure 7:
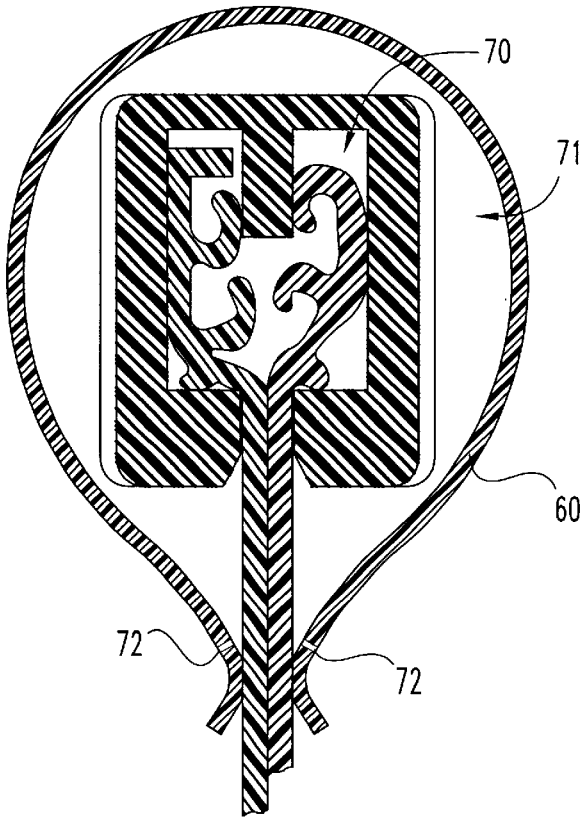
FIG. 7 is a vertical section similar to FIG. 3 of an alternative embodiment of the present invention.
Figure 7A:
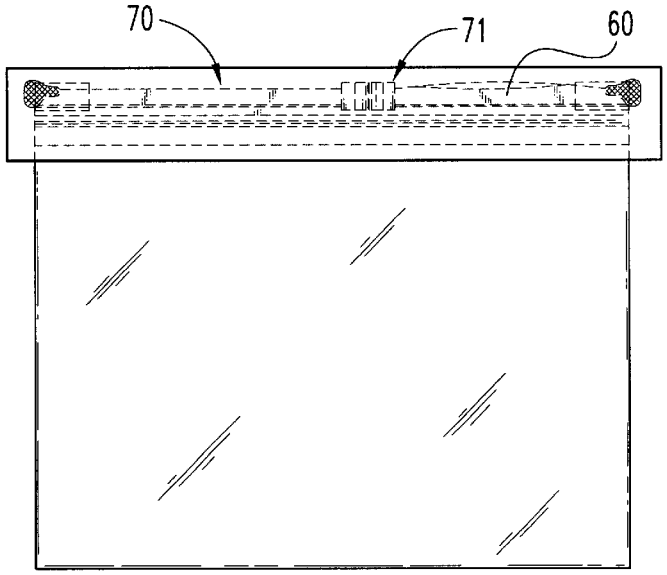
FIG. 7A is a front elevation similar to FIG. 1 of the alternative embodiment of the present invention.
Figure 7B:
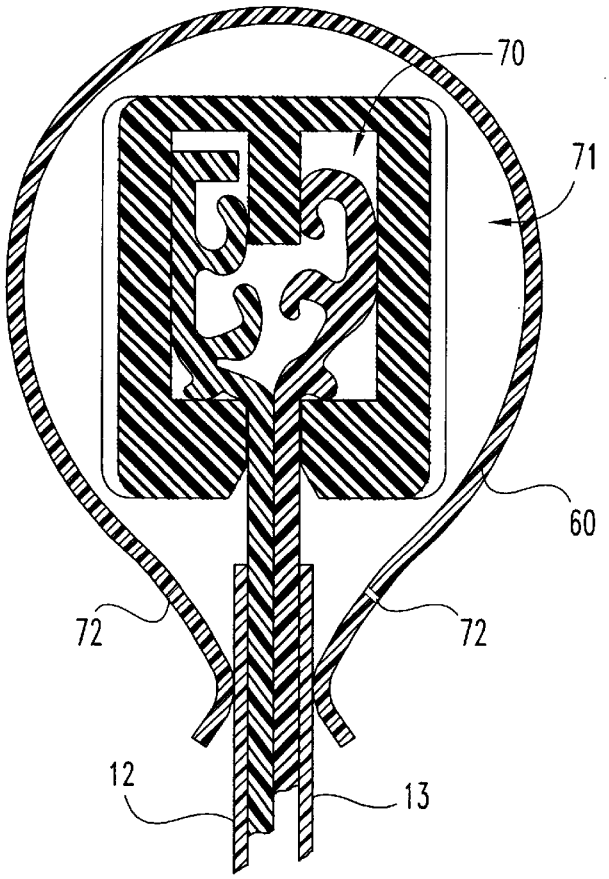
FIG. 7B is a view similar to FIG. 7 of an alternative embodiment of the present invention.
Figure 7C:
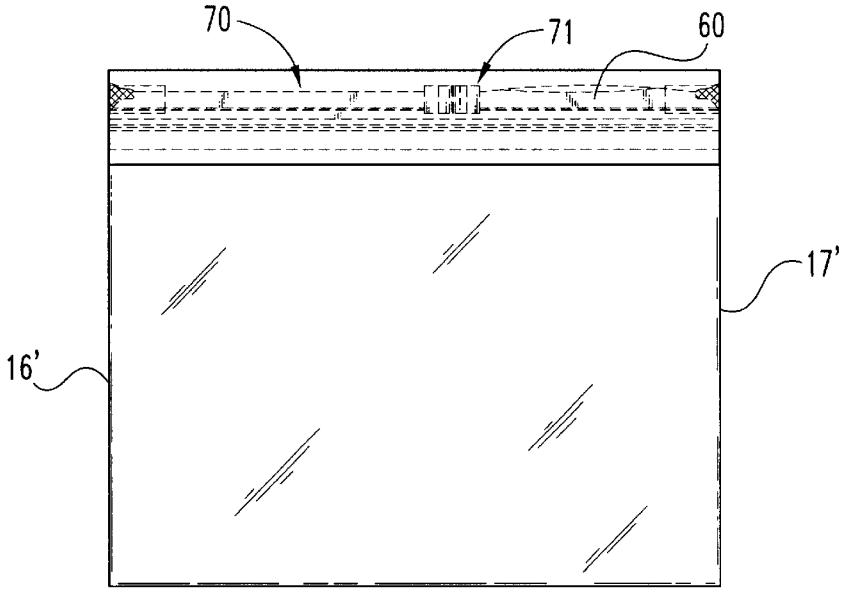
FIG. 7C is a view similar to FIG. 7A of a further alternative embodiment of the present invention.

Still another alternative embodiment of the invention is illustrated in FIGS. 7 and 7A. The reclosable closure and slider are identical to those above described except that the sheet 40 is eliminated. In place of the sheet 40 the tamper evident slider bag of FIG. 7 has a sheet 60 which forms a hood that covers and surrounds the reclosable closure 70 and the slider 71 of the bag of FIGS. 7 and 7A. In certain situations, the embodiment of FIG. 7 will be provided with perforations 72 which facilitate removing the tamper evident sheet 60. If desired perforations may also be provided in the embodiment of FIG. 8 such as for example at the location 61. The embodiment depicted in FIG. 7B is identical to that shown in FIG. 7 with the exception that sheet 60 is attached to side walls 12 and 13 and perforations 72 have been relocated. The embodiment shown in FIG. 7C is identical to that shown in FIG. 7A with the exception that the length of sheet 60 is decreased so that its edges are coextensive with the sideward edges 16 ' and 17' of the bag.

Figure 11:
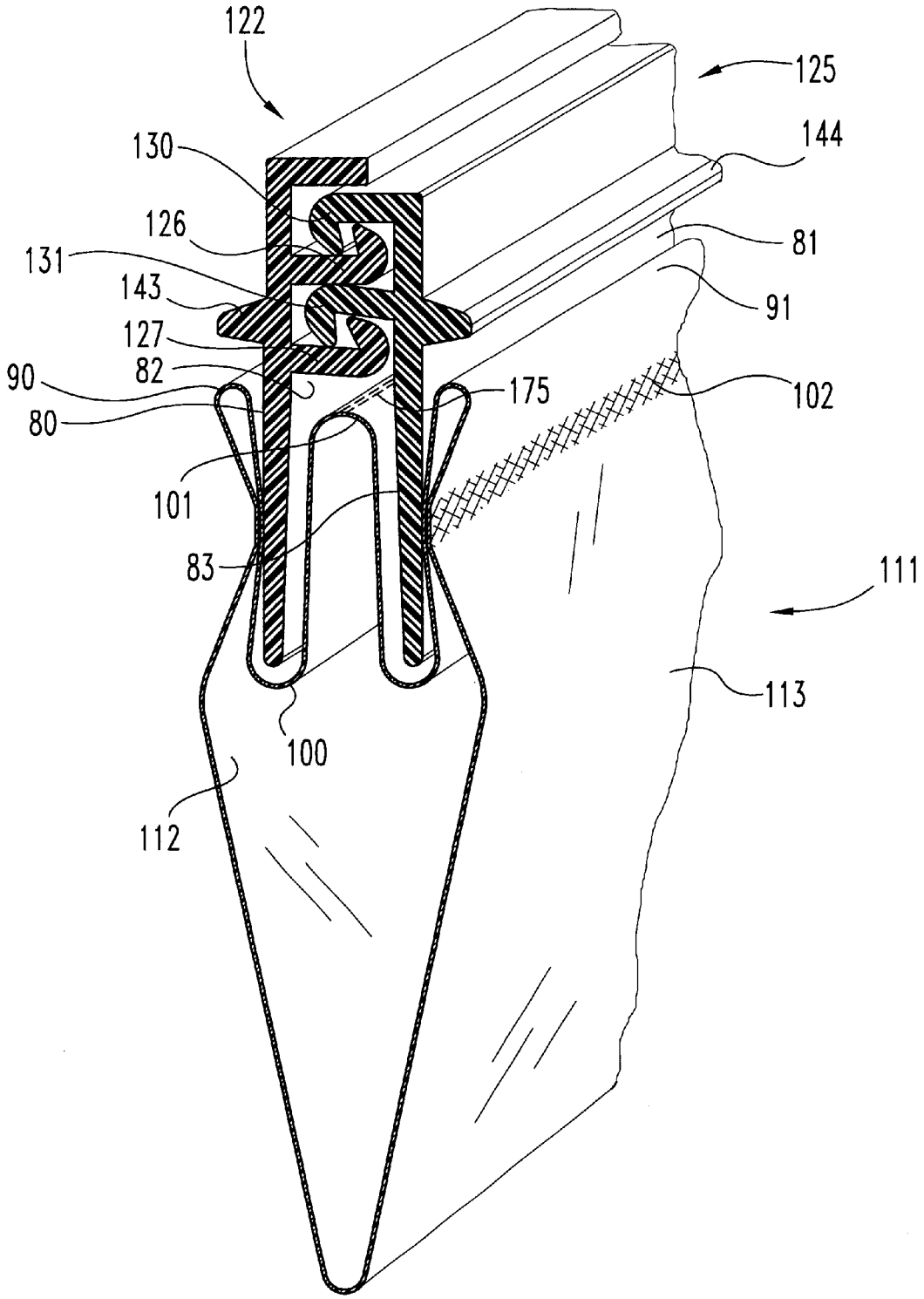
FIG. 11 is a fragmentary perspective sectional view of an alternative embodiment of the present invention.

In the embodiment shown in FIG. 11, side wall 113 is secured to outer face 81 of flexible plastic strip 125 at region 102 and side wall 112 is secured to outer face 80 of flexible plastic strip 122 at a similar location (not shown). The side walls may be secured to the flexible plastic strips by methods known in the art, including heat sealing and use of adhesives. The regions of the side walls closest to shoulders 143 and 144, upper regions 90 and 91 of side walls 112 and 113, respectively, form a sheet of plastic film 100 disposed between the side walls that acts as a tamper-evident closure.

In forming film 100, each of the pair of side walls 112 and 113 folds over itself as seen at upper regions 90 and 91. Film 100 typically extends along planes parallel to a plane passing between inner face 82 and outer face 80 of flexible plastic strip 122 and a plane passing between inner face 83 and outer face 81 of flexible plastic strip 125. However, film 100 may also extend along planes oblique or a plane perpendicular to a plane passing between inner face 82 and outer face 80 of flexible plastic strip 122 and a plane passing between inner face 83 and outer face 81 of flexible plastic strip 125 in this and the other embodiments discussed. Film 100 preferably has at least one curved region 101. The length of side walls 112 and 113 that form film 100 is typically that which allows the flexible plastic strips to separate from each other a greater distance when the rib and groove profile elements 126, 127, 130 and 131 are in a non-interlocked configuration and can be determined by one skilled in the art. In this way, film 100 acts as a gusset, thus allowing easier access to the film of plastic film bag 111.

The sheet of plastic film 100 preferably has a plurality of perforations 175 for facilitating its rupture. The plurality of perforations 175 is preferably located in curved region 101 but may be located at other places on film 100 as one skilled in the art would appreciate. Alternately, film 100 may be ruptured by cutting.

Figure 12:
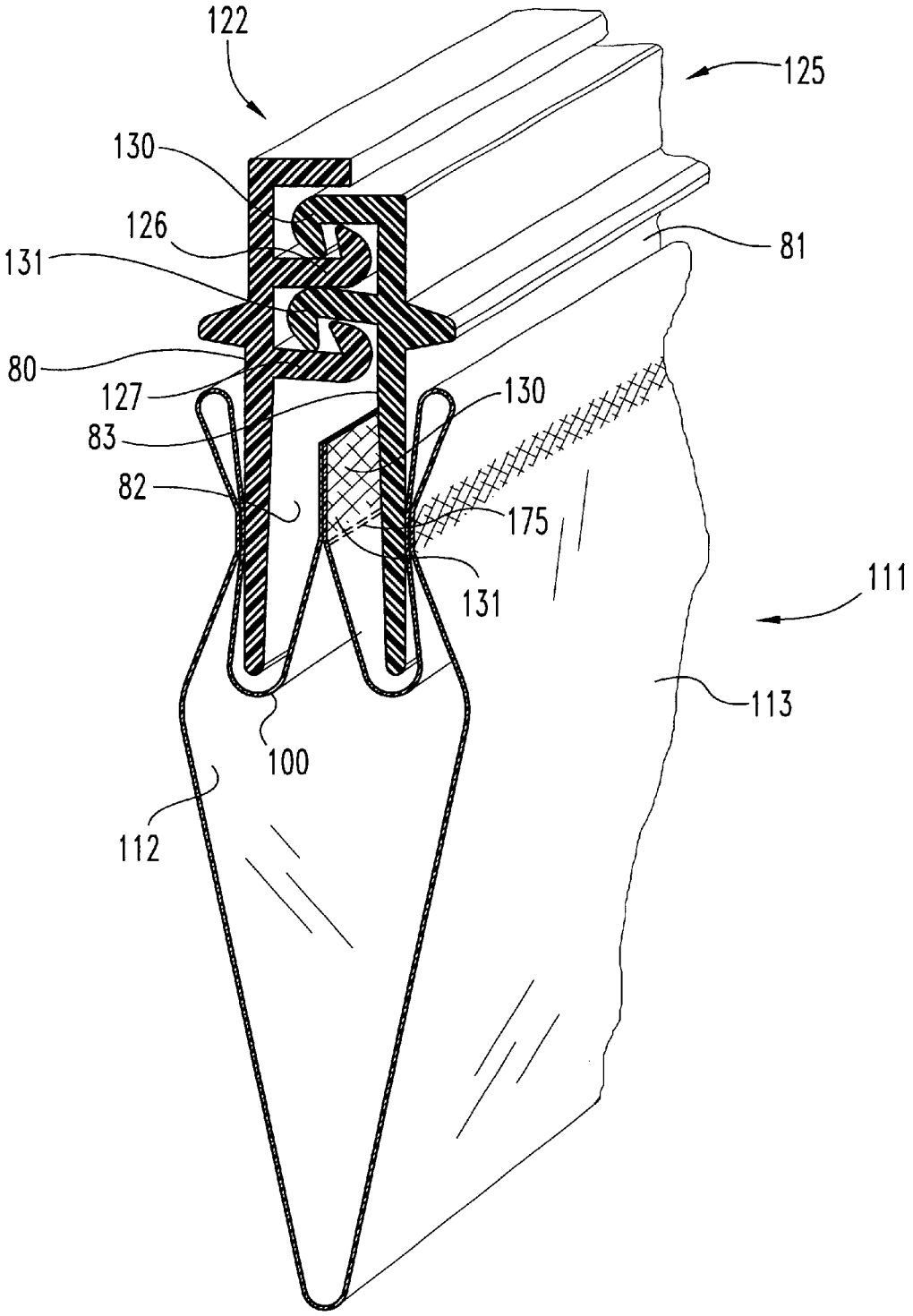
FIG. 12 is a view similar to FIG. 11 of a further alternative embodiment of the present invention.

The embodiment depicted in FIG. 12 is identical to that shown in FIG. 11 with the exception that curved region 101 of film 100 is replaced by a double layer of film joined together and defining a seal 130 that extends along the width of film 100 and film 100 extends along planes oblique to a plane passing between inner face 82 and outer face 80 of flexible plastic strip 122 and a plane passing between inner face 83 and outer face 81 of flexible plastic strip 125. Seal 130 may involve the two ends of film being secured together or may involve collapsing and sealing curved region 101. Base 131 of seal 130 may be weakened as a result of formation of the seal and may allow one to grasp and tear the seal to open bag 111. The ability to tear seal 130 to rupture film 100 will depend on the film thickness and the extent to which formation of seal 130 has weakened base 131 of the seal or the area around the base of the seal. Alternatively, a plurality of perforations 175 may be placed near or along base 131 of seal 130 to aid in rupturing the film. Film 100 may also be ruptured by cutting.

Figure 13:
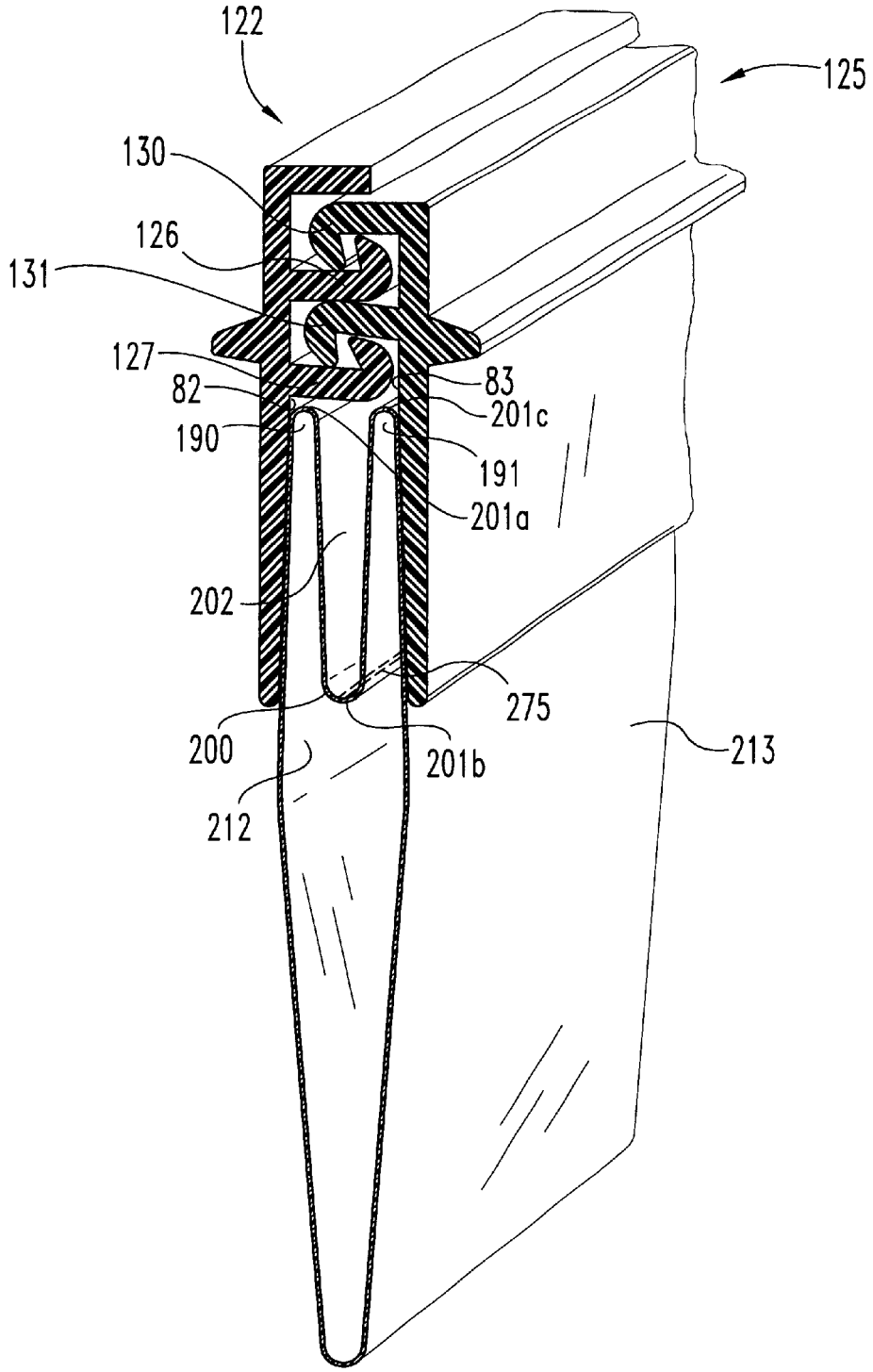
FIG. 13 is a view similar to FIG. 12 of another alternative embodiment of the present invention.

In the embodiment shown in FIG. 13, side wall 212 is secured to inner face 82 of flexible plastic strip 122 and side wall 213 is secured to inner face 83 of flexible plastic strip 125. The regions of the side walls closest to profile element 127, upper regions 190 and 191 of side walls 212 and 213, respectively, form a sheet of plastic film 200 disposed between the side walls. Film 200 is further disposed between the flexible plastic strips 122 and 125. Film 200 preferably has at least one curved region. In the embodiment shown in FIG. 13, film 200 has three curved regions 201*a*–201*c* and includes a U-shaped region 202 that functions as a gusset as described above. Film 200 and slider 35 (not shown in this figure) will not interfere with each other in this and similar embodiments (e.g., FIGS. 14 and 15) and the necessity of sealing two layers of film 200 is avoided.

The sheet of plastic film 200 preferably has a plurality of perforations 275 for facilitating its rupture. The plurality of perforations 275 is preferably located in any of the curved regions 201*a*–201*c* but may be located at other places on film 200 as one skilled in the art would appreciate. Alternately, film 200 may be ruptured by cutting.

Figure 14:
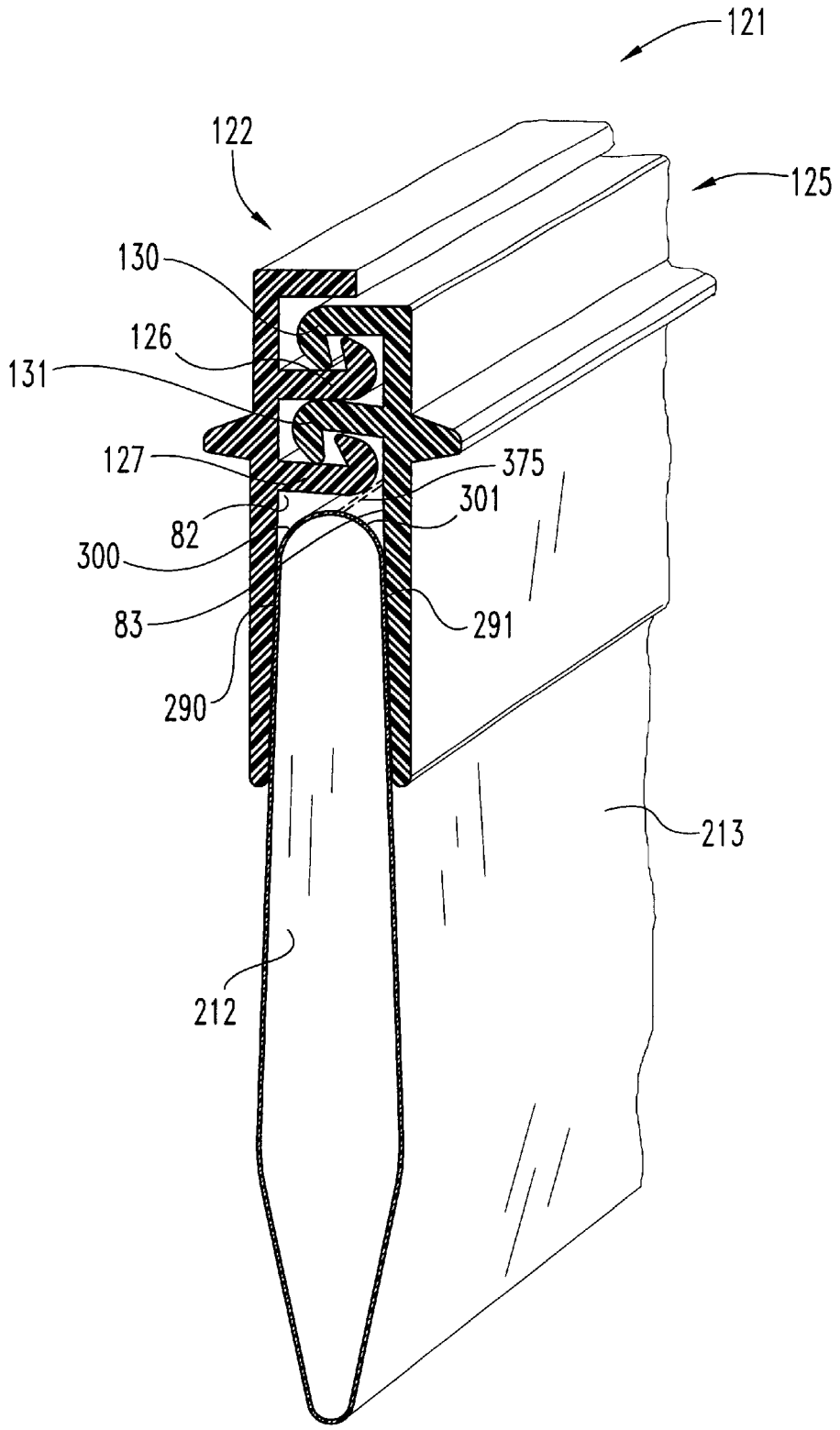
FIG. 14 is a view similar to FIG. 13 of a further alternative embodiment of the present invention.

The embodiment shown in FIG. 14 is similar to that shown in FIG. 13 except that only one curved region 301 is present. Side walls 212 and 213 are secured to inner faces 82 and 83 of flexible plastic strips 122 and 125, respectively, in a region of the side walls closer to profile element 127, upper regions 290 and 291 of side walls 212 and 213, respectively. This configuration allows for minimal spreading of fastener 121. That is, the flexible plastic strips of fastener 121 minimally spread from each other when the rib and groove profile elements 126, 127, 130 and 131 are in a non-interlocked configuration. Moreover, less excess film is present in this embodiment, thus minimizing interference of the film with the fastener.

The sheet of plastic film 300 preferably has a plurality of perforations 375 for facilitating its rupture. The plurality of perforations 375 is preferably located at curved region 301 but may be located at other places on film 300 as one skilled in the art would appreciate. Alternately, film 300 may be ruptured by cutting.

Figure 15:
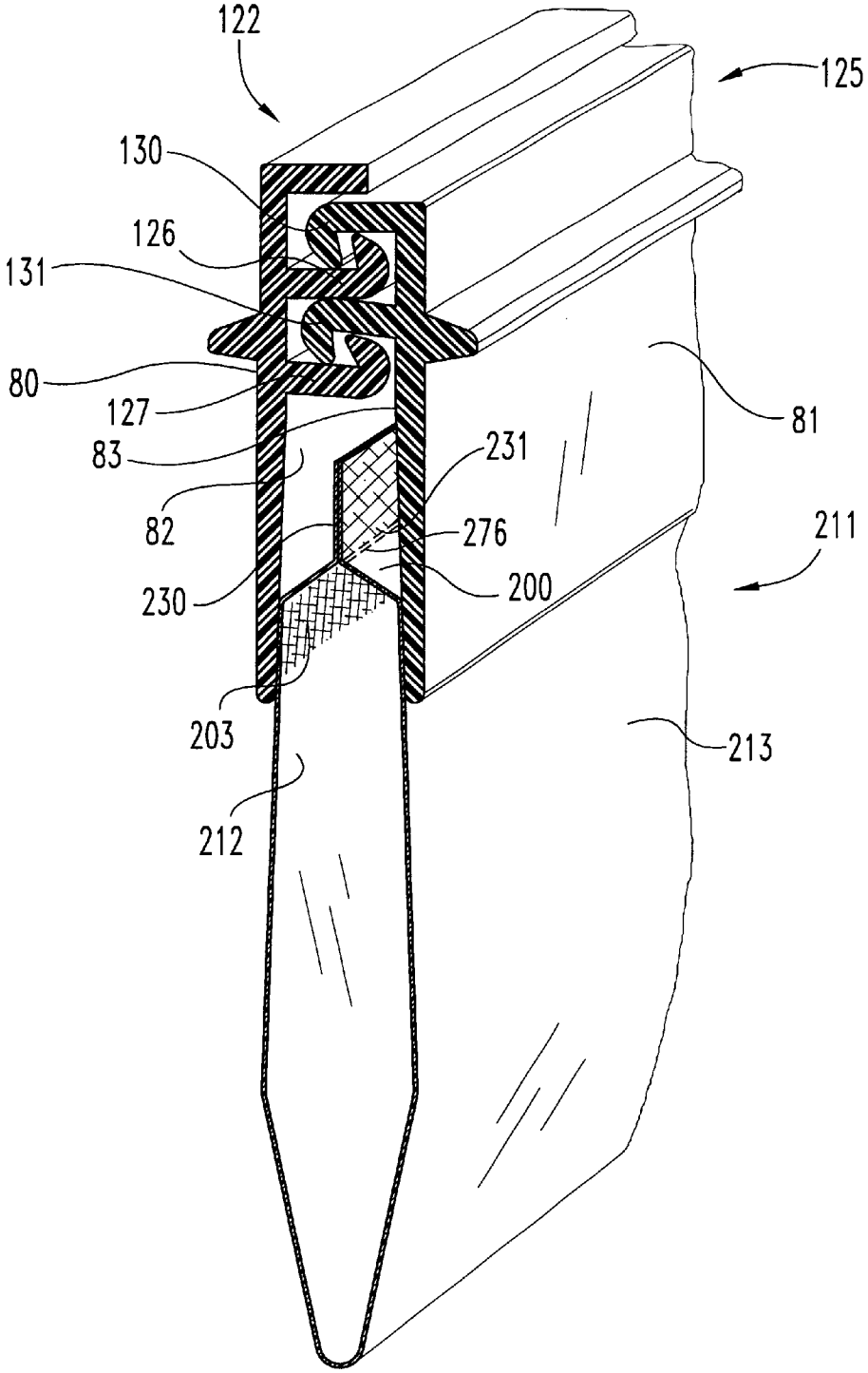
FIG. 15 is a view similar to FIG. 14 of another alternative embodiment of the present invention.

The embodiment shown in FIG. 15 is similar to that shown in FIG. 14 with the exception that the region of side walls 212 and 213 that are secured is more distant from profile element 127 than the region of side walls secured in the embodiment shown in FIG. 14. Specifically, region 203 of side wall 212 is secured to inner face 82 of flexible plastic strip 122 and a similar region (not shown) of side wall 213 is secured to inner face 83 of flexible plastic strip 125. One other difference in this embodiment compared to that shown in FIG. 14 is that curved region 301 is replaced by a double layer of film joined together and defining a seal 230 that extends along the width of film 200. Seal 230 may involve the two ends of film being secured together or may involve collapsing and sealing curved region 301 in FIG. 14. Furthermore, it can be seen that film 200 extends along planes oblique to a plane passing between inner face 82 and outer face 80 of flexible plastic strip 122 and a plane passing between inner face 83 and outer face 81 of flexible plastic strip 125.

As in the embodiment shown in FIG. 12, base 231 of seal 230 may be weakened as a result of formation of the seal and may allow one to grasp and tear the seal to open bag 211. Alternatively, a plurality of perforations 276 may be placed along base 231 of seal 230 to aid in rupturing the film. Film 200 may also be ruptured by cutting.

Figure 16:
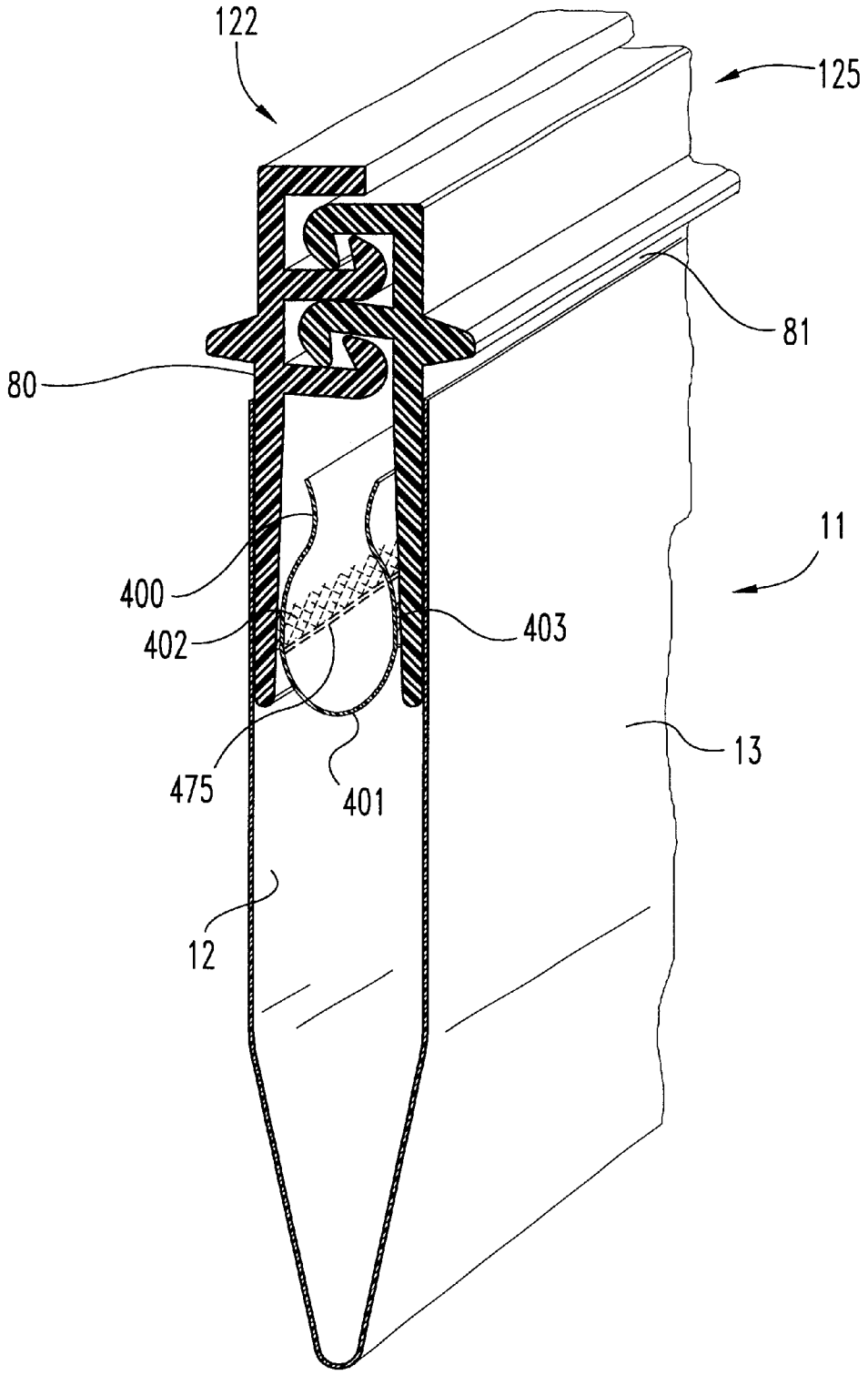
FIG. 16 is a view similar to FIG. 15 of a further alternative embodiment of the present invention.

FIG. 16 depicts a plastic film bag wherein side wall 112 is secured to outer face 80 of flexible plastic strip 122 and side wall 113 is secured to outer face 81 of flexible plastic strip 125. A sheet of plastic film 400 is disposed between side walls 12 and 13 and, in this embodiment, is also disposed between the pair of flexible plastic strips 122 and 125. Film 400 preferably has at least one curved region 401 and is typically secured to the pair of flexible plastic strips 122 and 125 by adhesive strips 402 and 403, respectively. However, film 400 may be secured to the pair of flexible plastic strips by other methods known in the art, including heat sealing.

As discussed when describing the other embodiments, film 400 may have a plurality of perforations 475 for facilitating its rupture or may simply be cut through. Alternatively, depending on the strength of the adhesive used, film 400 may be manually removed for entry into the bag.

It is to be noted that the sheet of flexible plastic film disposed between the side walls can have regions other than curved regions, including pleats and other forms of folds that will act as a gusset.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A plastic film bag comprising:

(a) a pair of side walls which are secured to one another and define a mouth of the bag;

(b) a reclosable fastener extending along the mouth of the bag and secured to said side walls, said fastener including a pair of flexible plastic strips secured to said side walls and including reclosable interlocking rib and groove profile elements on the respective strips, one of said plastic strips having an outer face, an inner face, and a bottom edge;

(c) a slider straddling the fastener for opening and closing the fastener, said slider including a depending separator extending between said flexible plastic strips; and (d) a sheet of plastic film closing the mouth of said bag, said sheet being capable of rupture to provide access and tamper evidence, said sheet having at least one curved region which curves from one of said outer face or said inner face of said one plastic strip around said bottom edge to the other said outer face or said inner face of said one plastic strip.

2. The plastic film bag of claim 1, wherein said side walls have side edges and a bottom, said side edges being secured to one another and terminating at said mouth, said sheet being inboard of said mouth and secured between said side edges.

3. The plastic film bag of claim 1, wherein said sheet of plastic film has a line of perforations therein facilitating rupture of said sheet.

4. The plastic film bag of claim 1, wherein said sheet is integral with said pair of reclosable plastic strips.

5. The plastic film bag of claim 1, wherein said sheet of plastic film has adhesive strips for securing said sheet to said pair of flexible plastic strips.

6. The plastic film bag of claim 1, wherein said sheet of plastic film has at least two curved regions.

7. The plastic film bag of claim 1, wherein said pair of sidewalls define an interior of the bag, and with a portion of said sheet of plastic film being within the interior.

8. The plastic film bag of claim 1, wherein at least one of said sidewalls folds over itself.

9. The plastic film bag of claim 1, wherein said sheet of plastic film folds over itself.

10. The plastic film bag of claim 1, wherein said sheet of plastic film is constructed and arranged to be manually removed for entry by a user of said bag into the interior of said bag.

11. The plastic film bag of claim 1, wherein said sheet of plastic film folds over itself forming at least one curved region.

12. A plastic film bag comprising:

a) a pair of side walls having an upper region, said pair of side walls secured to one another and defining a mouth of the bag, said upper region of said pair of side walls forming a sheet of plastic film disposed between said side walls for closing the mouth of said bag, said sheet being capable of rupture to provide access and tamper evidence;

b) a reclosable fastener extending along the mouth of the bag and secured to said side walls, said fastener including a pair of flexible strips secured to said side walls and including reclosable interlocking rib and groove profile elements on the respective strips; and c) a slider straddling the fastener for opening and closing the fastener, said slider including a depending separator extending between said flexible plastic strips;

wherein each of said pair of flexible plastic strips has an outer face and an inner face, and one of said pair of side walls is secured to the outer face of one of said pair of flexible plastic strips and the other of said pair of side walls is secured to the outer face of the other of said pair of flexible plastic strips.

13. The plastic film bag of claim 12, wherein said sheet of plastic film extends along planes parallel to a plane passing between said inner face and said outer face of each of said flexible plastic strips.

14. The plastic film bag of claim 13, wherein said sheet of plastic film has at least one curved region.

15. The plastic film bag of claim 12, wherein said sheet of plastic film allows said flexible plastic strips to separate from each other when said rib and groove profile elements are in a non-interlocked configuration.

16. The plastic film bag of claim 12, wherein said sheet of plastic film has a plurality of perforations therein for facilitating rupture of said sheet of plastic film.

17. The plastic film bag of claim 16, wherein said side walls that form said sheet of plastic film disposed between said side walls are of a length sufficient to allow access to said plurality of perforations.

18. The plastic film bag of claim 12, wherein said pair of sidewalls define an interior of the bag, and with a portion of said sheet of plastic film being within the interior.

19. The plastic film bag of claim 12, wherein at least one of said side walls folds over itself.

20. The plastic film bag of claim 12, wherein said sheet of plastic film folds over itself.

21. The plastic film bag of claim 12, wherein said sheet of plastic film folds over itself forming at least one curved region.

22. The plastic film bag of claim 12, wherein said sheet of plastic film has at least two curved regions.

23. The plastic film bag of claim 12, wherein said sheet of plastic film is constructed and arranged to be manually removed for entry by a user of said bag into the interior of said bag.

24. A plastic film bag comprising:

a) a pair of side walls having an upper region, said pair of side walls secured to one another and defining a mouth of the bag, said upper region of said pair of side walls forming a sheet of plastic film disposed between said side walls for closing the mouth of said bag, said sheet being capable of rupture to provide access and tamper evidence, wherein one of said pair of side walls folds over itself;

b) a reclosable fastener extending along the mouth of the bag and secured to said side walls, said fastener including a pair of flexible strips each having an outer face and an inner face and including reclosable interlocking rib and groove profile elements on the respective strips, said folded one of said pair of side walls being secured to said outer face of one of said pair of flexible plastic strips; and c) a slider straddling the fastener for opening and closing the fastener, said slider including a depending separator extending between said flexible plastic strips.

25. The plastic film bag of claim 24, wherein said sheet of plastic film extends along planes parallel to a plane passing between said inner face and outer face of each of said flexible plastic strips.

26. The plastic film bag of claim 24, wherein said pair of side walls defines an interior of the bag, and with a portion of said sheet of plastic film being within the interior.

27. The plastic film bag of claim 24, wherein said sheet of plastic film folds over itself.

28. The plastic film bag of claim 24, wherein said sheet of plastic film folds over itself forming at least one curved region.

29. The plastic film bag of claim 24, wherein said sheet of plastic film is constructed and arranged to be manually removed for entry by a user of said bag into the interior of said bag.

30. A plastic film bag comprising:

a pair of side walls which are secured to one another and define a mouth of the bag;

a reclosable fastener extending along the mouth of the bag and secured to said side walls, said fastener including a pair of flexible plastic strips secured to said side walls and including reclosable interlocking rib and groove profile elements on the respective strips;

a slider straddling the fastener for opening and closing the fastener, said slider including a depending separator extending between said flexible plastic strips; and a sheet of plastic film secured to said reclosable fastener, said sheet closing the mouth of said bag, said sheet being capable of rupture to provide access and tamper evidence;

wherein said sheet of plastic film is constructed and arranged to be manually removed for entry by a user of said bag into the interior of said bag and at least one of said side walls folds over itself.

31. The plastic film bag of claim 30, wherein said side walls have side edges and a bottom, said side edges being secured to one another and terminating at said mouth, said sheet being inboard of said mouth and secured between said side edges.

32. The plastic film gag of claim 30, wherein said sheet of plastic film has a line of perforations therein facilitating rupture of said sheet.

33. The plastic film gag of claim 30, wherein said sheet of plastic film has adhesive strips for securing said sheet to said pair of flexible plastic strips.

34. The plastic film bag of claim 30, said sheet of plastic film is secured to said pair of flexible plastic strips by heat sealing.

35. The plastic film bag of claim 30, wherein said sheet of plastic film folds over itself.

* * * * *